US010539916B2

(12) United States Patent
Iwasaki

(10) Patent No.: US 10,539,916 B2
(45) Date of Patent: Jan. 21, 2020

(54) IMAGE FORMING APPARATUS AND LUBRICANT APPLICATION DEVICE

(71) Applicant: FUJI XEROX CO., LTD., Tokyo (JP)

(72) Inventor: Jin Iwasaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/687,620

(22) Filed: Aug. 28, 2017

(65) Prior Publication Data

US 2018/0101121 A1 Apr. 12, 2018

(30) Foreign Application Priority Data

Oct. 6, 2016 (JP) ..... 2016-197791

(51) Int. Cl.
*G03G 21/00* (2006.01)

(52) U.S. Cl.
CPC ..... *G03G 21/0094* (2013.01); *G03G 21/00* (2013.01)

(58) Field of Classification Search
CPC ..... G03G 21/00; G03G 21/0094
USPC ..... 399/127, 346
See application file for complete search history.

(56) References Cited

U.S. PATENT DOCUMENTS 6,562,529 B1 * 5/2003 Kojima ..... G03G 5/147 399/174
9,841,718 B2 * 12/2017 Ogura ..... G03G 21/0011
2005/0025520 A1 * 2/2005 Murakami ..... G03G 21/08 399/111
2012/0315065 A1 * 12/2012 Akiba ..... D06M 11/74 399/175
2016/0320742 A1 * 11/2016 Ishida ..... G03G 21/0094

FOREIGN PATENT DOCUMENTS

JP 8-314346 A 11/1996
JP 2006-139111 A 6/2006
JP 2006-235015 A 9/2006
JP 2006-235563 A 9/2006
JP 2007292866 A * 11/2007
JP 2008129355 A * 6/2008
JP 2008203584 A * 9/2008
JP 2008233477 A * 10/2008
JP 2009162790 A * 7/2009
JP 2010210859 A * 9/2010
JP 2013120192 A * 6/2013
JP 2013182126 A * 9/2013

* cited by examiner

*Primary Examiner* — Robert B Beatty
(74) *Attorney, Agent, or Firm* — Sughrue Mion, PLLC

(57) ABSTRACT

An image forming apparatus includes an image holder; a developing device that creates a toner image by developing a latent image held on the image holder; and an application member that scrapes a lubricant from a solid lubricant and applies the scraped lubricant onto the image holder, wherein a surface of the application member is a fabric member that holds toner.

20 Claims, 3 Drawing Sheets

IMAGE FORMING APPARATUS AND LUBRICANT APPLICATION DEVICE

CROSS-REFERENCE TO RELATED APPLICATIONS

This application is based on and claims priority under 35 USC 119 from Japanese Patent Application No. 2016-197791 filed Oct. 6, 2016.

BACKGROUND

Technical Field

The present invention relates to an image forming apparatus and a lubricant application device.

SUMMARY

According to an aspect of the invention, there is provided an image forming apparatus including: an image holder; a developing device that creates a toner image by developing a latent image held on the image holder; and an application member that scrapes a lubricant from a solid lubricant and applies the scraped lubricant onto the image holder, wherein a surface of the application member is a fabric member that holds toner.

BRIEF DESCRIPTION OF THE DRAWINGS

An exemplary embodiment of the present invention will be described in detail based on the following figures, wherein.

DETAILED DESCRIPTION

Figure 1:
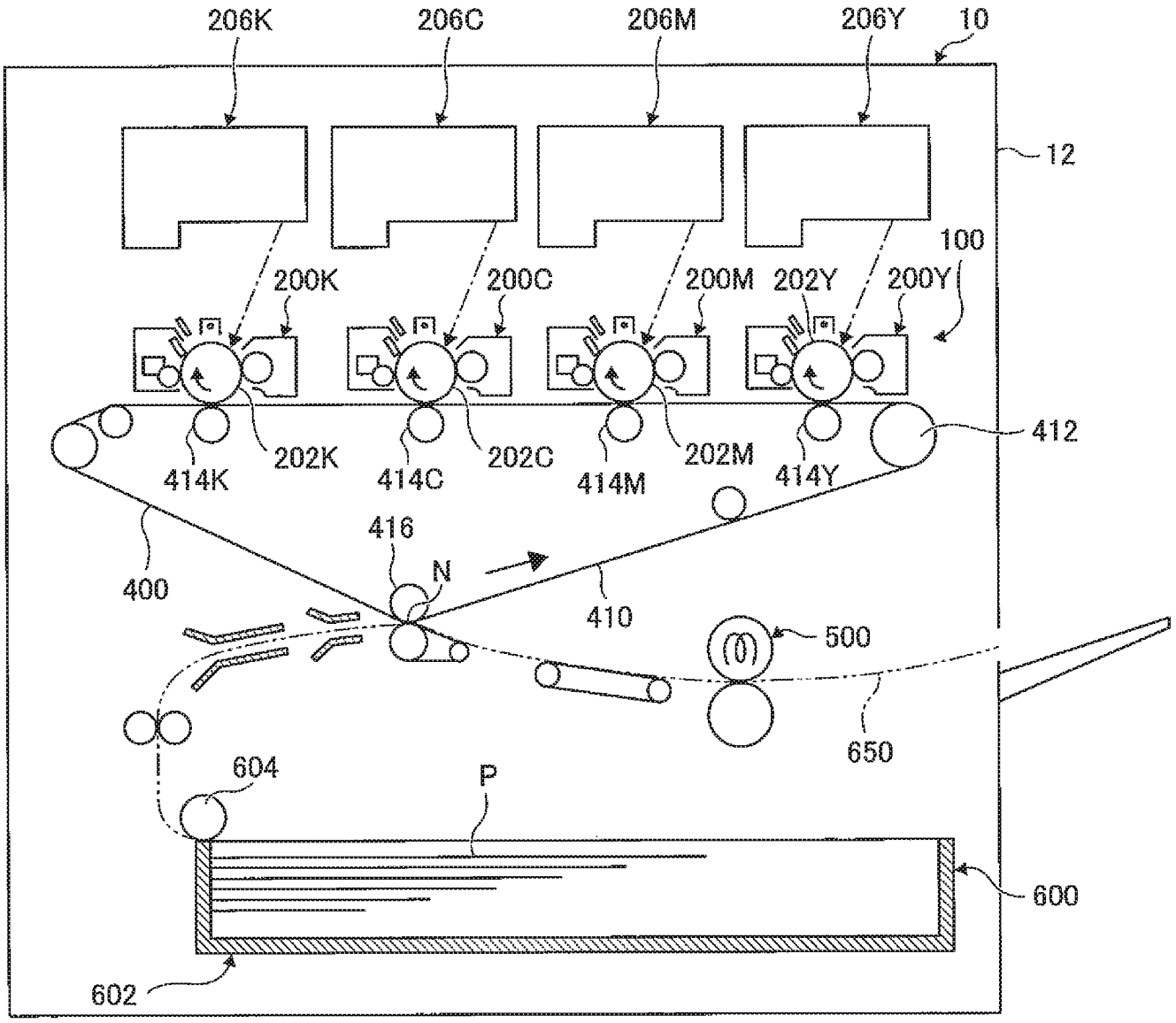
FIG. 1 illustrates a configuration of an image forming apparatus used in an exemplary embodiment of the present invention.

An exemplary embodiment of the present invention is described below with reference to the drawings. FIG. 1 illustrates an image forming apparatus 10 according to the exemplary embodiment of the present invention. The image forming apparatus 10 includes an image forming apparatus body 12, and an image forming part 100, a transfer device 400, a fixing device 500, and a paper feeding device 600 are disposed in the image forming apparatus body 12. A transport path 650 for transporting a sheet of paper P that is a recording medium is provided in the image forming apparatus body 12.

The image forming part 100 forms an image on the sheet of paper P by electrophotography. The image forming part 100 includes, for example, four image forming units 200Y, 200M, 200C, and 200K. The image forming units 200Y forms a yellow toner image, the image forming units 200M forms a magenta toner image, the image forming units 200C forms a cyan toner image, and the image forming units 200K forms a black toner image.

The image forming units 200Y, 200M, 200C, and 200K have photoconductor drums 202Y, 202M, 202C, and 202K that are image holders, respectively. Toner images are formed on surfaces of the respective photoconductor drums, and the toner images thus formed are transferred (first transfer) onto an intermediate transfer belt 410 that will be described later. Details of the image forming units 200Y, 200M, 200C, and 200K will be described later.

The transfer device 400 has the intermediate transfer belt 410. Toner images are transferred (first transfer) from the photoconductor drums 202Y, 202M, 202C, and 202K onto the intermediate transfer belt 410, and the toner images thus transferred (first transfer) are transferred (second transfer) onto the sheet of paper P that is a recording medium.

The intermediate transfer belt 410 is supported by plural support members so as to be rotatable, and a driving roller 412 that is one of the plural support members transfers driving force to the intermediate transfer belt 410.

The transfer device 400 further has first transfer rollers 414Y, 414M, 414C, and 414K that transfer toner images from the photoconductor drums 202Y, 202M, 202C, and 202K onto the intermediate transfer belt 410, respectively, and a second transfer roller 416 that transfers the toner images from the intermediate transfer belt 410 onto the sheet of paper P.

The fixing device 500 fixes, on the sheet of paper P, the toner images transferred onto the sheet of paper P, for example, by using heat and pressure.

The paper feeding device 600 has a containing part 602 in which stacked sheets of paper P are contained and a delivering roller 604 that delivers a sheet of paper P contained in the containing part 602 toward the transport path 650.

The transport path 650 transports the sheet of paper P from the paper feeding device 600 to a second transfer nip N, then to the fixing device 500, and finally to an outside of the image forming apparatus body 12.

In the image forming apparatus 10 configured as above, toner images formed on the photoconductor drums 202Y, 202M, 202C, and 202K are transferred (first transfer) onto the intermediate transfer belt 410, the toner images transferred (first transfer) onto the intermediate transfer belt 410 are transferred (second transfer) onto the sheet of paper P, and the toner images transferred (second transfer) onto the sheet of paper P are fixed on the sheet of paper P by the fixing device 500. The arrows in FIG. 1 indicate directions in which the photoconductor drums 202Y, 202M, 202C, and 202K and the intermediate transfer belt 410 rotate during image formation.

The image forming units 200Y, 200M, 200C, and 200K have an identical configuration. Hereinafter, the image forming units 200Y, 200M, 200C, and 200K are collectively referred to as an image forming unit 200.

Figure 2:
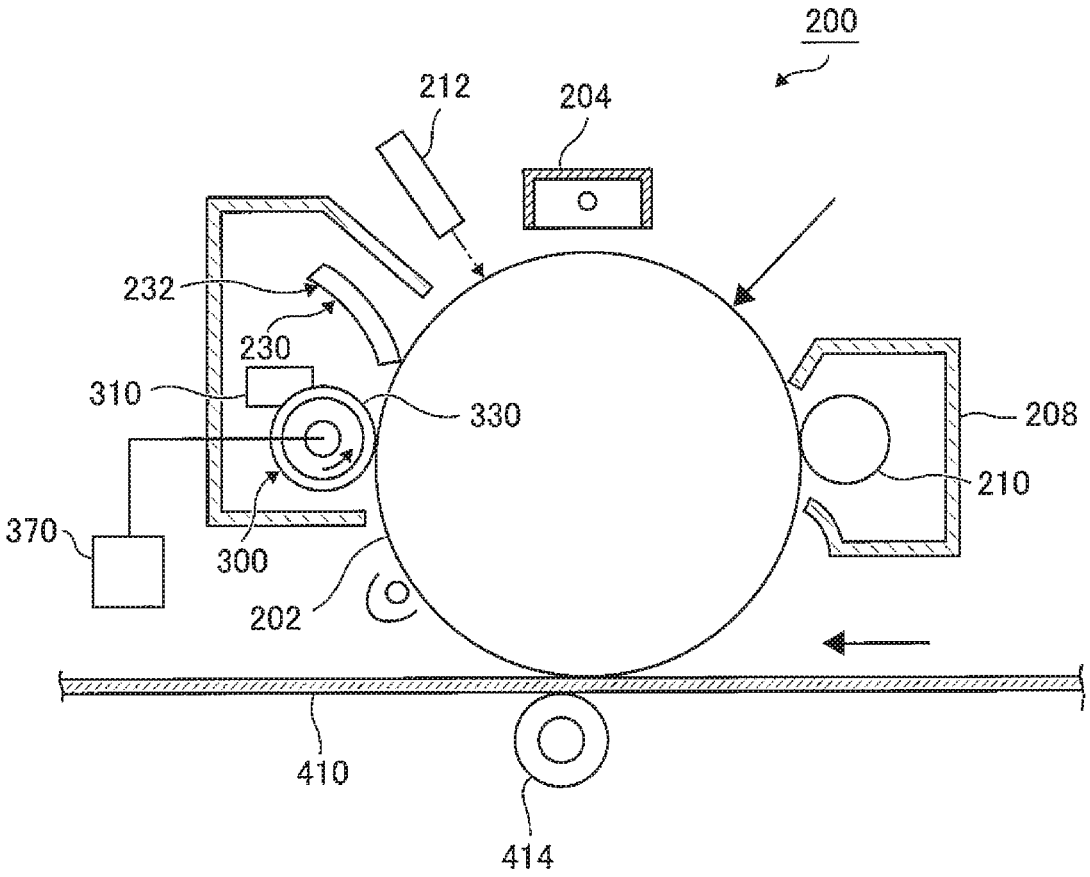
FIG. 2 illustrates a structure of an image forming part used in the exemplary embodiment of the present invention.

FIG. 2 illustrates the image forming unit 200. The image forming unit 200 has the photoconductor drum 202 described above and further has a charging device 204 that charges a surface of the photoconductor drum 202, a latent image forming device 206 (see FIG. 1) that forms a latent image on the charged surface of the photoconductor drum 202, a developing device 208 that creates a toner image by developing the latent image held on the photoconductor drum 202, a cleaning device 230 that removes toner remaining on the surface of the photoconductor drum 202 after transfer of the toner image onto the intermediate transfer belt 410 by the first transfer roller 414, and an eliminating device 212 that eliminates electricity from the surface of the photoconductor drum 202 cleaned by the cleaning device 230.

The developing device 208 has a development roller 210. The development roller 210 is disposed in contact with the photoconductor drum 202 or disposed with a slight gap interposed therebetween. The development roller 210 has, on a surface thereof, a developer made up of toner and carrier and feeds the toner to the photoconductor drum 202. The developing device 208 is used as a toner feeding unit that feeds toner to an application roller 330 that will be described later.

The cleaning device 230 has a cleaning blade 232. One end of the cleaning blade 232 is in contact with the photoconductor drum 202. The cleaning device 230 cleans the surface of the photoconductor drum 202 by scraping off toner, paper dust, and the like from the surface of the photoconductor drum 202.

The photoconductor drum 202 may be, for example, a photoconductor drum including a photoconductor layer made of an organic photoconductor (OPC) and a hardened film layer (over coat (OC) layer). The hardened film layer is provided on the surface of the photoconductor drum 202 and has high hardness. The hardened film layer lessens wear of the photoconductor drum 202, thereby contributing, for example, to prolongation of lifetime of the photoconductor drum 202. The hardened film layer is formed, for example, from a resin layer having a crosslinked structure. More specifically, the hardened film layer can be formed from a crosslinked resin and at least one reactive group that forms a crosslinked structure. The crosslinked resin can be, for example, at least one selected from among a guanamine resin, a siloxane resin, a phenolic resin, and a melamine resin.

In the image forming unit 200 configured as above, the surface of the photoconductor drum 202 wears off, for example, because the development roller 210, the carrier held by the development roller 210, and the cleaning blade 232 make contact with the surface of the photoconductor drum 202. Furthermore, the cleaning blade 232, with which the photoconductor drum 202 makes contact, wears off. In view of this, the image forming apparatus 10 according to the present exemplary embodiment has a lubricant application device 300 that adjusts an amount of wear of the photoconductor drum 202 by supplying a lubricant to the surface of the photoconductor drum 202 and thereby lessening wear of the photoconductor drum 202 and the cleaning blade 232.

The photoconductor drum 202 is desirably hard to wear off from the perspective of durability, but if the photoconductor drum 202 is too hard to wear off, a discharge product tends to accumulate on the surface of the photoconductor drum 202, and accumulation of the discharge product on the surface of the photoconductor drum 202 increases the likelihood of occurrence of a defect such as a white patch on a formed image.

The lubricant application device 300 has a solid lubricant 310 and an application roller 330. The solid lubricant 310 is, for example, a lubricant solidified, for example, in a block, and zinc stearate can be, for example, used as the lubricant.

The application roller 330 is in contact with the photoconductor drum 202 and the solid lubricant 310, rotates in the same direction as the photoconductor drum 202 as indicated by the arrow in FIG. 2, scrapes the lubricant from the solid lubricant 310, and applies the scraped lubricant onto the photoconductor drum 202. The application roller 330 may rotate in a reverse direction to the photoconductor drum 202 instead of rotating in the same direction as the photoconductor drum 202. Details of the structure of the application roller 330 will be described later.

A voltage application device 370 is attached to the application roller 330. The voltage application device 370 applies, to the application roller 330, a voltage for moving toner from the photoconductor drum 202 to the application roller 330. The voltage application device 370 may apply a DC voltage, may apply a voltage including an alternating-current voltage, or may be grounded.

Figure 3:
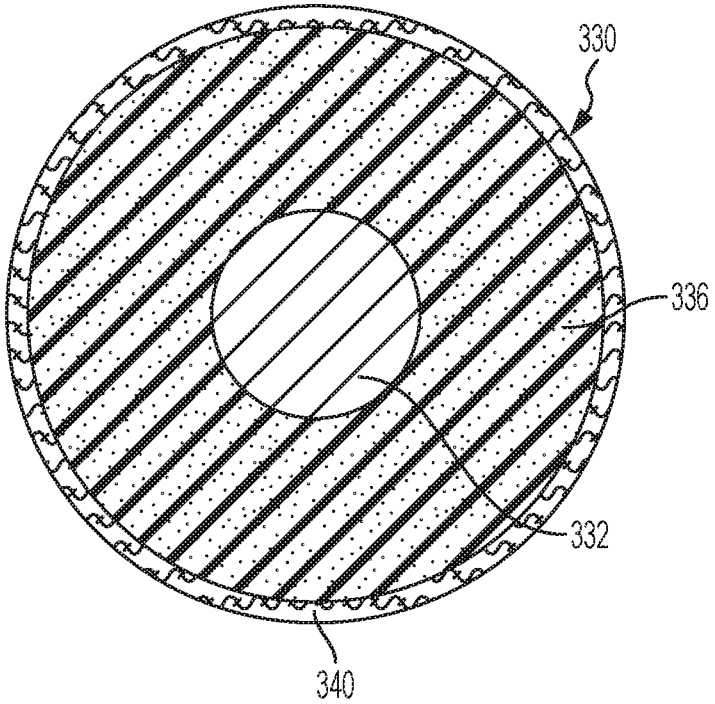
FIG. 3 illustrates a structure of an application roller used in the exemplary embodiment of the present invention.

FIG. 3 is a cross-sectional view of the application roller 330. As illustrated in FIG. 3, the application roller 330 has a shaft member 332. The shaft member 332 is electrically conductive, for example, made of a metal. The voltage application device 370 is connected to the shaft member 332.

The application roller 330 further has an elastic layer 336. The elastic layer 336 is disposed so as to cover the shaft member 332 and be located on an inner side of a fabric member 340 that will be described later. The elastic layer 336 can be, for example, rubber or foam. The elastic layer 336 makes it possible to increase contact between the application roller 330 and the photoconductor drum 202 since the elastic layer 336 is elastically deformed when the application roller 330 is pressed against the photoconductor drum 202. It is desirable that the elastic layer 336 be electrically conductive.

The fabric member 340 is a member that holds toner and can be, for example, a non-woven fabric. The non-woven fabric is a fabric made not by weaving fibers but by entwining fibers. The fibers of which the non-woven fabric is made are desirably electrically conductive and can be, for example, a mixed fiber material combining nylon and polyester. The fabric member 340 can be made electrically conductive by using electrically conductive fibers as a material of the fabric member 340.

A fabric obtained by knitting fibers can be used as the fabric member 340 instead of the non-woven fabric. Alternatively, a fabric obtained, for example, by plain-weaving fibers can be used as the fabric member 340 instead of the non-woven fabric. Also in a case where a knitted fabric or a woven fabric is used as the fabric member 340, the fibers of which the fabric member 340 is made are desirably electrically conductive and can be, for example, a mixed fiber material combining nylon and polyester.

Irrespective of whether a non-woven fabric, a fabric obtained by knitting fibers, or a fabric obtained by weaving fibers is used as the fabric member 340, it is desirable to use, as the material, microfibers having a thickness of 1 denier or less. Use of fibers having a thickness of 1 denier or less may make it hard for toner to infiltrate into a gap between adjacent fibers.

In the image forming apparatus 10 configured as above, at a timing when a process for forming an image on a sheet of paper P is not performed (during a non-image-formation period), for example, every time formation of five hundred images is completed, the developing device 208 supplies toner to the photoconductor drum 202 by forming a toner band (a solid image formed from toner) on the surface of the photoconductor drum 202. The supplied toner reaches the application roller 330 without being transferred onto the intermediate transfer belt 410 by the first transfer roller 414, and at least part of the toner forming the toner band is attached to the fabric member 340 of the application roller 330. In this process, the voltage application device 370 may be driven so that a voltage for moving the toner onto the surface of the application roller 330 is generated.

The application roller 330 having the toner attached to the fabric member 340 rotates to scrape the lubricant from the solid lubricant 310 and applies the scraped lubricant to the surface of the photoconductor drum 202. If the toner is not attached to the fabric member 340, a surface of the fabric member 340 is covered with the lubricant. This may undesirably lower a coefficient of friction on the surface of the fabric member 340, thereby preventing the lubricant from being scraped from the solid lubricant 310 well.

Meanwhile, in the present exemplary embodiment, toner is attached to the surface of the fabric member 340, and the lubricant is attached to a surface of this toner. This prevents the coefficient of friction on the surface of the fabric member 340 from becoming excessively low, thereby allowing the lubricant to be scraped from the solid lubricant 310 well.

According to a technique of scraping the lubricant from the solid lubricant 310 by using a brush instead of the application roller 330 described above and applying the scraped lubricant to the photoconductor drum 202, toner infiltrates into a gap between bristles of the brush, thereby clogging the bristles and, for example, unevenly solidifying the bristles. This may undesirably cause an amount of toner attached to the bristles of the brush to vary from one position to another, thereby making an amount of lubricant scraped from the solid lubricant 310 by the bristles uneven, ultimately resulting in unevenness in amount of lubricant applied to the photoconductor drum 202.

Meanwhile, in the present exemplary embodiment, in which the surface of the application roller 330 is the fabric member 340, toner is not clogged between fibers unlike the case of a brush, and therefore toner may be held evenly on the surface of the application roller 330 as compared with the case of a brush. Therefore, as compared with the case of a brush, the lubricant may be evenly scraped from the solid lubricant 310, and the lubricant may be evenly applied to the surface of the photoconductor drum 202.

Examples of the present invention and comparative examples to be compared with the examples are described below.

EXAMPLE 1

In the above exemplary embodiment, the application roller 330 using a non-woven fabric as the fabric member 340 is used, a toner band is formed on the photoconductor drum 202 by using the developing device 208 every time formation of five hundred images is completed, and an image having an image portion in which a toner image is formed and a non-image portion in which a toner image is not formed in an axial direction of the photoconductor drum 202 is formed on three hundred thousand sheets of paper. As a result, after formation of the image on the three hundred thousand sheets of paper, the fabric member 340 holds toner both in the image portion and the non-image portion. Furthermore, the cleaning blade 232 has no broken part such as a dented part both in the image portion and the non-image portion. Furthermore, no defect such as a white patch is found both in the image portion and the non-image portion. Wear in the axial direction of the photoconductor drum 202 is 4 nm/kcyc at maximum and 3.5 nm/kcyc at minimum.

COMPARATIVE EXAMPLE 1

Formation of an image on three hundred thousand sheets of paper is attempted by using the same conditions as those in Example 1 except for that no toner band is formed on the photoconductor drum 202. As a result, the cleaning blade 232 breaks after formation of the image on ten thousand sheets of paper. After formation of the image on the ten thousand sheets of paper, the fabric member 340 holds toner in the image portion but does not hold toner in the non-image portion. The cleaning blade 232 has no broken part in the image portion, but has a broken part such as a dented part in part of the non-image portion. No defect such as a white patch is found in the image portion, but a defect such as a white patch is found in the non-image portion. It is impossible to measure wear of the photoconductor drum 202 because the cleaning blade is broken after formation of the image on the ten thousand sheets of paper.

COMPARATIVE EXAMPLE 2

A brush including no flicker bar is used instead of the application roller 330, a toner band is formed on the photoconductor drum 202 by using the developing device 208 every time formation of five hundred images is completed, and an image is formed on three hundred thousand sheets of paper. As a result, after formation of the image on the three hundred thousand sheets of paper, toner is attached between bristles of the brush both in the image portion and the non-image portion, and the bristles are solidified. The cleaning blade 232 has no broken part in the non-image portion, but has a broken part such as a dented part in the image portion. No defect such as a white patch is found in the non-image portion, but a defect such as a white patch is found in the image portion. Wear in the axial direction of the photoconductor drum 202 is 6 nm/kcyc at maximum and 2 nm/kcyc at minimum.

COMPARATIVE EXAMPLE 3

A brush including a flicker bar is used instead of the application roller 330, a toner band is formed on the photoconductor drum 202 by using the developing device 208 every time formation of five hundred images is completed, and an image is formed on three hundred thousand sheets of paper. As a result, after formation of the image on the three hundred thousand sheets of paper, the brush holds toner in the image portion, but hardly holds toner in the non-image portion. The cleaning blade 232 has no broken part in the image portion, but has a broken part such as a dented part in the non-image portion. No defect such as a white patch is found in the image portion, but a defect such as a white patch is found in the non-image portion. Wear in the axial direction of the photoconductor drum 202 is 5 nm/kcyc at maximum and 3.5 nm/kcyc at minimum.

EXAMPLE 2

In the above exemplary embodiment, the application roller 330 using a fabric obtained by weaving fibers as the fabric member 340 is used, a toner band is formed on the photoconductor drum 202 by using the developing device 208 every time formation of five hundred images is completed, and an image having an image portion in which a toner image is formed and a non-image portion in which a toner image is not formed in an axial direction of the photoconductor drum 202 is formed on three hundred thousand sheets of paper. As a result, after formation of the image on the three hundred thousand sheets of paper, the fabric member 340 holds toner both in the image portion and the non-image portion. Furthermore, the cleaning blade 232 has no broken part such as a dented part both in the image portion and the non-image portion. Furthermore, no defect such as a white patch is found both in the image portion and the non-image portion. Wear in the axial direction of the photoconductor drum 202 is 4 nm/kcyc at maximum and 3.7 nm/kcyc at minimum.

EXAMPLE 3

In the above exemplary embodiment, the application roller 330 using a fabric obtained by knitting fibers as the fabric member 340 is used, a toner band is formed on the photoconductor drum 202 by using the developing device 208 every time formation of five hundred images is completed, and an image having an image portion in which a toner image is formed and a non-image portion in which a toner image is not formed in an axial direction of the photoconductor drum 202 is formed on three hundred thousand sheets of paper. As a result, after formation of the image on the three hundred thousand sheets of paper, the fabric member 340 holds toner both in the image portion and the non-image portion. Furthermore, the cleaning blade 232 has no broken part such as a dented part both in the image portion and the non-image portion. Furthermore, no defect such as a white patch is found both in the image portion and the non-image portion. Wear in the axial direction of the photoconductor drum 202 is 4.2 nm/kcyc at maximum and 3.8 nm/kcyc at minimum.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder; and an application member configured to have a surface that scrapes a lubricant from a solid lubricant and apply the scraped lubricant onto an image holder, wherein the surface of the application member is a bristleless fabric member configured to hold toner, wherein the bristleless fabric member comprises microfibers having a thickness of 1 denier or less, and wherein the bristleless fabric member is a mixed fiber material combining nylon and polyester.

2. The image forming apparatus according to claim 1, wherein the application member comprises an elastic layer on an inner side of the fabric member.

3. An image forming apparatus comprising:

an image holder;

an application member configured to have a surface that scrapes a lubricant from a solid lubricant and apply the scraped lubricant onto an image holder, wherein the surface of the application member is a bristleless fabric member configured to hold toner, wherein the fabric member is electrically conductive;

wherein the image forming apparatus further comprises a voltage application device configured to apply a voltage for attaching toner to the fabric member, wherein the bristleless fabric member comprises microfibers having a thickness of 1 denier or less, and wherein the bristleless fabric member is a mixed fiber material combining nylon and polyester.

4. The image forming apparatus according to claim 2, wherein the fabric member is electrically conductive; and wherein the image forming apparatus further comprises a voltage application device configured to apply a voltage for attaching toner to the fabric member.

5. The image forming apparatus according to claim 3, wherein the fabric member is a fabric made of electrically conductive fibers.

6. The image forming apparatus according to claim 4, wherein the fabric member is a fabric made of electrically conductive fibers.

7. The image forming apparatus according to claim 1, further comprising a toner feeding unit configured to feed toner to the fabric member.

8. The image forming apparatus according to claim 2, further comprising a toner feeding unit configured to feed toner to the fabric member.

9. The image forming apparatus according to claim 3, further comprising a toner feeding unit configured to feed toner to the fabric member.

10. The image forming apparatus according to claim 4, further comprising a toner feeding unit configured to feed toner to the fabric member.

11. The image forming apparatus according to claim 5, further comprising a toner feeding unit configured to feed toner to the fabric member.

12. The image forming apparatus according to claim 6, further comprising a toner feeding unit configured to feed toner to the fabric member.

13. The image forming apparatus according to claim 1, wherein the image holder has, in a surface thereof, a resin layer having a crosslinked structure.

14. The image forming apparatus according to claim 1, wherein the lubricant comprises zinc stearate.

15. A lubricant application device comprising:

an application member configured to have a surface that scrapes a lubricant from a solid lubricant and apply the scraped lubricant onto an image holder holding a toner image, wherein the surface of the application member is a bristleless fabric member configured to hold toner, wherein the bristleless fabric member comprises microfibers having a thickness of 1 denier or less, and wherein the bristleless fabric member is a mixed fiber material combining nylon and polyester.

16. An application roller comprising:

an outermost peripheral surface comprising a bristleless fabric configured to hold toner;

wherein the outermost peripheral surface is configured to scrape a lubricant from a solid lubricant and to apply the scraped lubricant onto a photoconductor drum, wherein the bristleless fabric comprises microfibers having a thickness of 1 denier or less, and wherein the bristleless fabric is a mixed fiber material combining nylon and polyester.

17. The application roller according to claim 16, wherein the application roller comprises an elastic layer on an inner side of the fabric.

18. The application roller according to claim 16, wherein the fabric member is electrically conductive.

19. An image forming apparatus comprising:

an image holder;

a developing device configured to create a toner image by developing a latent image held on the image holder; and an application member configured to have a surface that scrapes a lubricant from a solid lubricant and apply the scraped lubricant onto the image holder, wherein the surface of the application member is a bristleless fabric member that is configured to hold toner, wherein the application member comprises an elastic layer on an inner side of the fabric member, wherein the bristleless fabric member comprises microfibers having a thickness of 1 denier or less, and wherein the bristleless fabric member is a mixed fiber material combining nylon and polyester.

20. The image forming apparatus according to claim 1, comprising a developing device configured to create a toner image by developing a latent image held on the image holder.

* * * * *